United States Patent [19]

Kompanek et al.

[11] Patent Number: 4,658,897

[45] Date of Patent: Apr. 21, 1987

[54] DOWNHOLE TRANSDUCER SYSTEMS

[75] Inventors: Harry W. Kompanek; James R. Ligman, both of Santa Barbara; Eric D. Plambeck, Carpinteria, all of Calif.

[73] Assignee: Piezo Sona-Tool Corporation, Carpinteria, Calif.

[21] Appl. No.: 635,191

[22] Filed: Jul. 27, 1984

[51] Int. Cl.[4] ..... E21B 33/14

[52] U.S. Cl. ..... 166/249; 166/286

[58] Field of Search ..... 166/249, 286, 177, 285

[56] References Cited

U.S. PATENT DOCUMENTS

| | | | |
|---|---|---|---|
| 2,187,088 | 1/1940 | Malan | 166/177 |
| 3,049,185 | 8/1962 | Herbold | 166/177 |
| 3,113,621 | 12/1963 | Krueger et al. | 166/249 |
| 3,322,196 | 5/1967 | Bodine, Jr. | 166/249 |
| 3,557,875 | 1/1971 | Solum et al. | 166/286 |
| 4,257,482 | 3/1981 | Kompanek | 166/249 |
| 4,512,402 | 4/1985 | Kompanek et al. | 166/249 |

*Primary Examiner*—James A. Leppink
*Assistant Examiner*—Hoang C. Dang
*Attorney, Agent, or Firm*—Ellsworth R. Roston; Charles H. Schwartz

[57] ABSTRACT

A casing in an oil well is constructed to provide for the flow of oil in the well. The casing cylindrical and may be perforated. The casing is resonant in a hoop mode at a particular fundamental frequency such as approximately 400 hertz. A transducer includes a transducer member disposed within a tubing in spaced relationship to the tubing. The transducer member may be a ceramic slotted at one end and supported by the tubing at the other end. A ring may envelope the ceramic member and may be slotted at the same position as the ceramic member. The tubing may be filled with a fluid which provides dielectric properties and operates to transmit vibrations from the transducer to the tubing. The transducer may vibrate in the hoop mode at the fundamental frequency of resonance of the casing. These vibrations are transmitted to the casing through the fluid in the tubing, the tubing and the oil in the casing to produce a resonance of the casing at the particular fundamental frequency in the hoop mode. Wet concrete is disposed around the casing. The transducer is then moved slowly upwardly, while vibrating the transducer, to eliminate any gas, oil or mud pockets in the concrete while the concrete is still wet. The upward movement of the transducer may be temporarily interrupted at positions where the gas, oil and mud pockets are known or suspected to exist.

13 Claims, 5 Drawing Figures

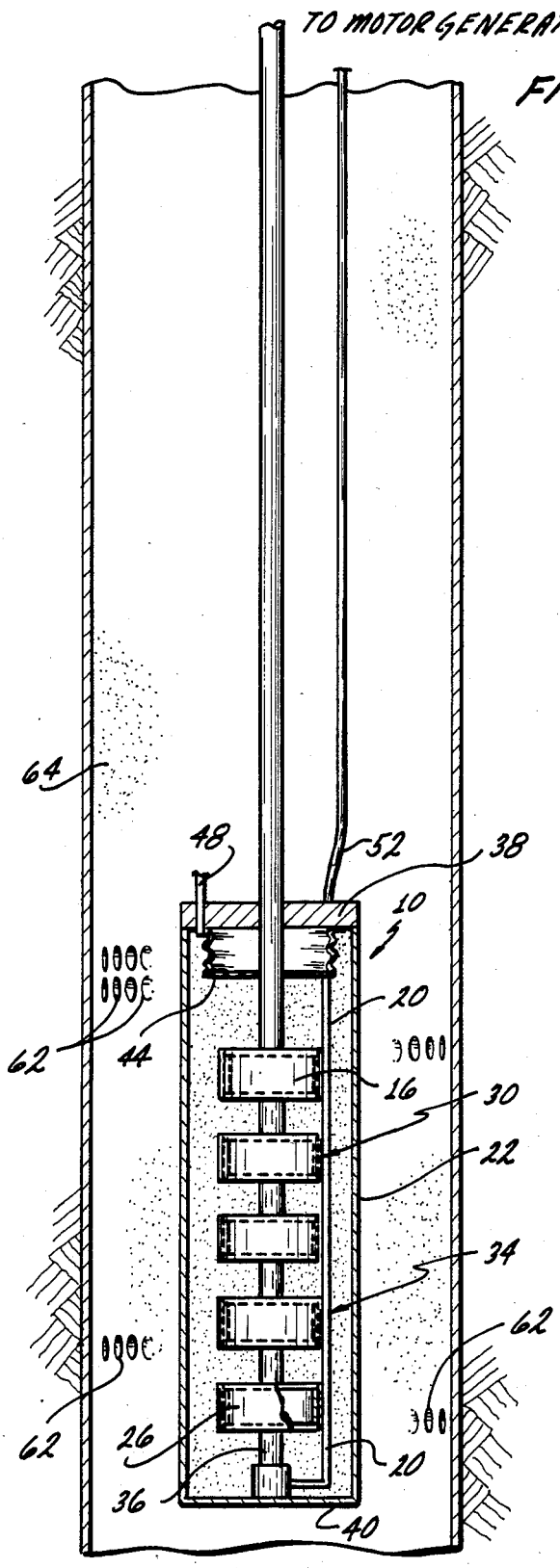
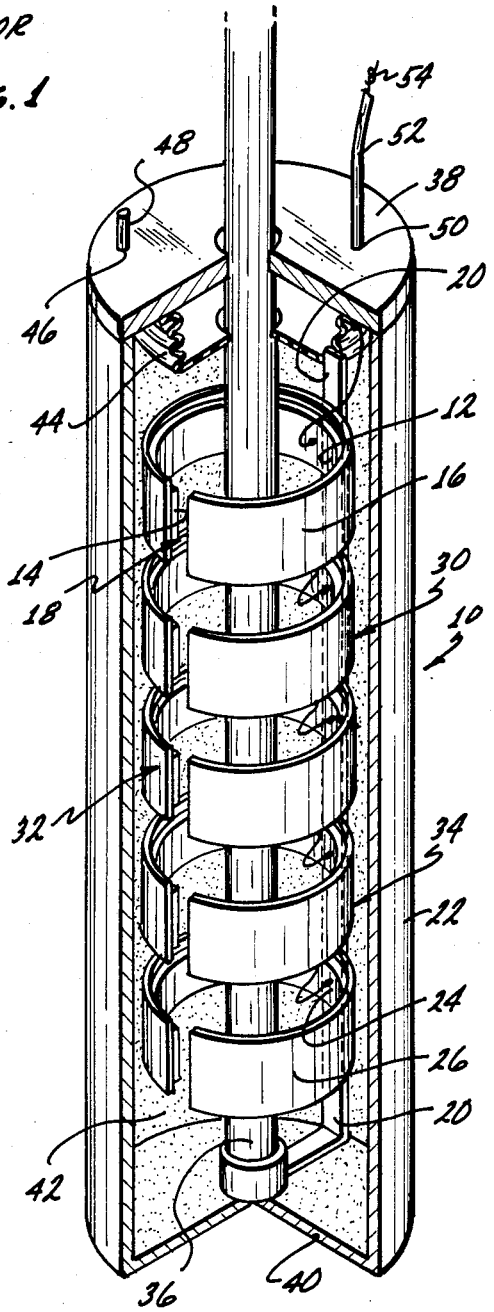
FIG. 2

DOWNHOLE TRANSDUCER SYSTEMS

This invention relates to apparatus for, insuring that concrete around a casing in an oil well is solidly parked without any pockets of gas, oil or mud in the pockets.

Before oil is pumped from a well, a casing is disposed in the oil and concrete is packed around the casing and is allowed to set. Holes are then bored through the casing and the concrete to establish a communication between the interior of the casing and the earth around the concrete. Oil is then able to flow into the casing from the earth around the casing and then to be pumped through the casing to the earth's surface.

When the concrete is poured around the casing, pockets of mud, oil or gas are often formed in the concrete. These pockets considerably reduce the strength of the concrete and minimize the forces which can be introduced into the well to pump the fluid from the well. The existence of the pockets, and the limitations imposed by the pockets have been known to exist for an extended period of time. A considerable effort has been devoted during this extended period to overcome this problem but the problem has continued to persist in spite of such efforts.

In one embodiment of the invention, a casing is disposed in an oil well and is constructed to provide for the flow of oil in the well. For example, the casing may be cylindrical and may be perforated in its cylindrical wall. The casing is resonant in a hoop mode at a particular fundamental frequency. This fundamental frequency may be in the order of approximately 400 hertz.

A transducer includes a transducer member disposed within a tubing in spaced relationship to the tubing. The transducer member may be a ceramic slotted at one end and supported by the tubing at the other end. A ring may envelope the ceramic member and may be slotted at the same position as the ceramic member. The tubing may be filled with a fluid which provides dielectric properties and operates to transmit vibrations from the transducer to the tubing.

The transducer may vibrate in the hoop mode at the fundamental frequency of resonance of the casing. The transducer member is energized to obtain the production of vibrations in the transducer in the hoop mode. These vibrations are transmitted to the casing through the fluid in the tubing, the tubing and the oil in the casing to produce a resonance of the casing at the particular fundamental frequency in the hoop mode.

Wet concrete is disposed around the casing. The transducer is then moved slowly upwardly, while vibrating the transducer, to eliminate any gas, oil or mud pockets in the concrete while the concrete is still wet. The upward movement of the transducer may be temporarily interrupted at positions where the gas, oil and mud pockets are known or suspected to exist.

In the secondary recovery of oil, frequencies in the order of four hundred (400) hertz been attempted to be generated with the apparatus discussed in the previous paragraph. As will be appreciated, such a frequency is difficult to obtain when the pipe is in the order of one hundred fifty feet (150') long and is heavy. Although the use of resonant techniques is generally known to be desirable in promoting the recovery of oil, no resonant system has been successfully provided to this date to promote the recover of oil, particularly when the recovery is secondary.

This invention provides apparatus for overcoming the disadvantages discussed above. The apparatus consists of a downhole tool which may vary in length from approximately two feet (2') to forty feet (40'). The tool vibrates a casing in the hoop or radial mode of the casing at a frequency in the order of four hundred (400) hertz. The frequency constitutes the resonant frequency of the casing, thereby facilitating the production of vibrations of large amplitude in the casing and promoting the flow of fluid in the oil well.

In the drawings:

FIG. 1 is a schematic view of an oil well and apparatus included in the oil well to enhance the flow of oil in the oil well, such apparatus constituting one embodiment of the invention;

FIG. 2 is a enlarged fragmentary perspective view illustrating details of construction of the apparatus shown in FIG. 1;

Figure 3:
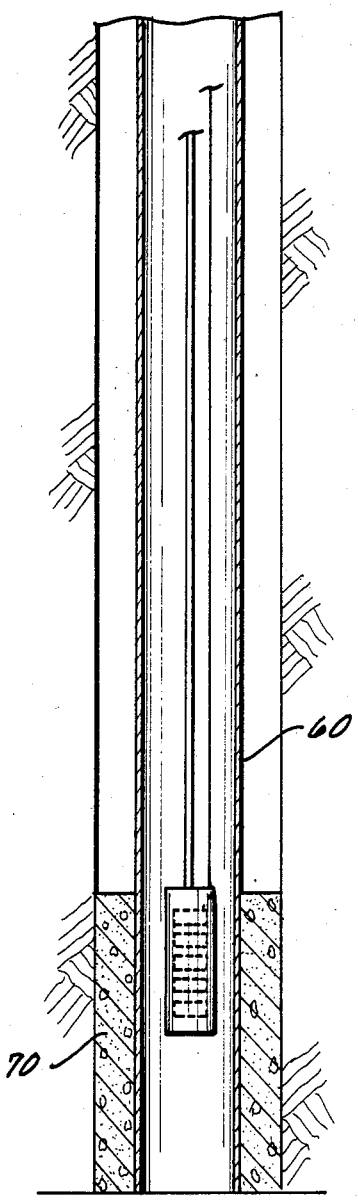
FIG. 3 is a fragmentary sectional view of an oil well and the apparatus shown in FIGS. 1 and 2 and illustrates the disposition of such apparatus at a relatively low position in the oil well to obtain the removal of pockets of mud, oil and mud.
Figure 4:
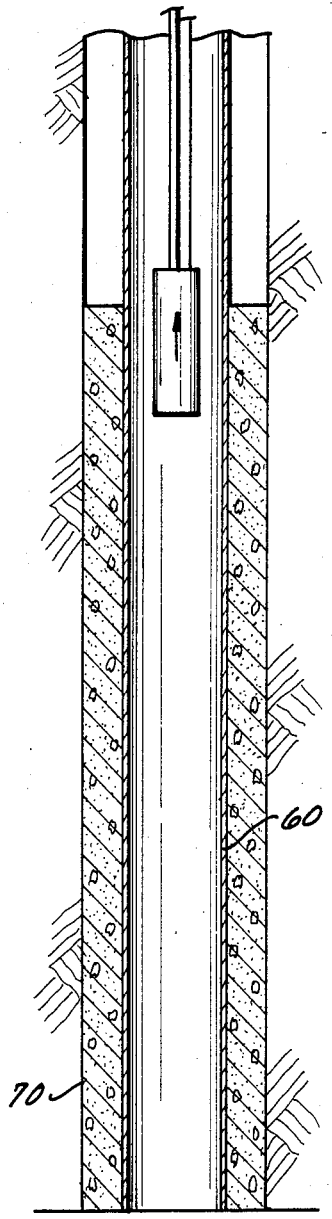
FIG. 4 is a view similar to that of FIG. 3 and illustrates the disposition of the apparatus at a raised position in the oil well.
Figure 5:
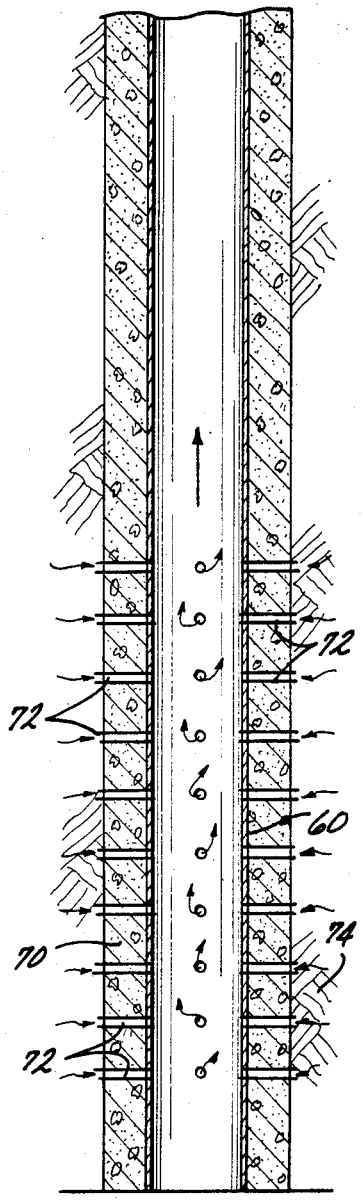
FIG. 5 is a view similar to that of FIGS. 1 and 2 but illustrates that appearance of the oil well after holes have been provided in the oil well to facilitate the pumping of oil through the well.

In the embodiment of the invention shown in the drawings, a transducer generally indicated at 10 may include a transducer member 12. The transducer member 12 may be made from a suitable material such as lead zirconate and lead titanate to have piezoelectric properties. The ceramic transducer member 12 is preferably provided with an annular configuration and is preferably slotted axially as at 14. The axial slotting of the transducer member 12 facilitates the production of vibratory energy at high power levels without breaking the transducer.

The transducer member 12 is disposed within a ring 16 which may be made from a suitable material such as aluminum. The transducer member 12 is preferably bonded to the inner surface of the ring 16. The ring 16 is preferably slotted as at 18, the slot being aligned with the slot 14 in the transducer.

The ring 16 may be clamped at a position which is preferably diametrically opposite the slot in the ring. The clamping may be provided by a mounting rod 20 which is suitably attached to a tubing 22. The tubing 22 may be disposed in concentric relationship with the transducer 12 and the ring 14 and may be spaced from the ring. The sleeve 22 is preferably made from a suitable metal such as aluminum or stainless steel.

A transducer member 24 and a ring 26 respectively corresponding to the transducer member 12 and the ring 16 may also be provided. The assembly of the transducer member 12 and the ring 16 and the assembly of the transducer member 24 and the ring 26 are disposed in a spaced, coaxial relationship in the sleeve 22. Slots in the transducer member 24 and the ring 26 may coincide in annular position with the slots in the transducer member 12 and the ring 16. However, the slots in the transducer member 24 and the ring 26 may be angularly displaced from the slots in the transducer member 12 and the ring 16 without departing from the scope of the invention.

The assembly of the transducer member 12 and the ring 16 may be disposed adjacent the assembly of the transducer member 24 and the ring 26. Alternatively, the plurality of assemblies generally indicated at 30, 32 and 34 may be disposed between the assembly including the transducer member 24 and the ring 26. Thus, as will be appreciated, only one transducer assembly may be employed or any number of transducer assemblies in excess of one may be employed.

A support rod 36 extend axially through the sleeve 20 and the transducer members 12 and 24. The rod 36 may be dependent from the bottom of the pump (not shown). End plates 38 and 40 are disposed at opposite ends of the sleeve 22 and are coupled to the support rod 36 and the mounting rod 20 to provide a support of the sleeve 22.

The sleeve 22 is preferably filled with an oil 42 such as a silicon oil. The oil 42 may be provided with characterisitics to lubricate the different parts and to communicate vibrations from the transducer members such as the transducer members 12 and 24 to the sleeve 22. A bellows 44 is preferably disposed adjacent the end plate 38. The bellows 44 expands or contracts with changes in temperature to provide compensations within the sleeve 22 for changes in the space occupied by the oil 42 in accordance with such changes in temperature and pressure.

A passage 46 extends through the end plate 38 and communicates with the hollow interior of the sleeve 22 to provide for the introduction of oil into the sleeve. The passage 46 may be sealed by a plug 48. A passage 50 also extends through the end cap 32. A plug 52 may be provided to seal the passage 50. The passage 50 provides for the introduction of an electrode 54 to the transducer members such as the members 12 and 24 to energize the transducer members with a suitable potential such as a positive potential. The positive potential may be obtained from electronic circuits or from a motor generator. A negative potential may be provided by the electrical grounding of the sleeve 22 or the introduction of a negative potential to the sleeve.

A casing 60 envelopes the tubing 22. The casing 60 may be perforated as indicated at 62 to provide for the passage of oil 64 through the perforations 62 into the space between the tubing 22 and the casing 60. The oil 64 in the casing 60 accordingly functions to transmit to the casing vibrations produced in the transducer members such as the transducer members 12 and 24. The casing 60 may be provided with characteristics to resonate at a particular fundamental frequency such as a frequency of approximately four hundred (400) hertz.

The transducer members such as the transducer members 12 and 24, the rings such as the rings 16 and 26 and the tubing 22 are provided with characteristics to resonate at a frequency corresponding to the resonant frequency of the casing 60. This resonant frequency is dependent upon the characteristics of the casing 60. The casings 60 used in the oil fields generally have the following characteristics:

| Outer Diameter in Inches | Inner Diameter In Inches | Percentage of Fields |
|---|---|---|
| 7 | 6.366 | 60 |
| 6⅝ | 5.885 | 7 |
| 5½ | 4.892 | 30 |
| 4½ | 4.00 | 3 |

Tests have been successfully performed in oil wells having an outer diameter of approximately seven inches (7″). The resonant frequencies of such casings have been in the order of three hundred and seventy (370) hertz. In such tests, the tubing 22 has been made of steel and has been provided with a diameter of approximately four inches (4″). The tubing 22 has been provided with a length between approximately two feet (2′) and forty feet (40′). The rings such as the rings 16 and 26 have been made of steel and have been provided with an outer diameter or approximately three and one-half inches (3½″) and a wall thickness of approximately one-fourth inch (¼″). The transducer members such as the transducer members 12 and 24 have been provided with an outer diameter of approximately three inches (3″). The transducer members have been made from lead zirconate and lead titanate. When more than one (1) transducer is used, the transducers may be separated from one another by a suitable distance such as approximately two inches (2″).

When electrical energy is applied to the transducer members such as the transducer members 12 and 24, the transducer members and their associated rings vibrate. These vibrations are transmitted to the tubing 22 through the oil 42 in the tubing to produce vibrations of the tubing in the "hoop" or radial mode and are then transmitted to the casing 60 through the oil in the casing. The casing 60 accordingly vibrates in the "hoop" or radial mode. These vibrations occur at the resonant frequency of the casing because the characteristics of the transducer members such as the transducer members 12 and 24, the rings such as the rings 16 and 26 and the casing 22 are selected to provide a resonance at a frequency corresponding substantially to the resonance of the casing 60.

Since the casing 60 vibrates at substantially its resonant frequency, the vibrations have a very large amplitude. These vibrations are so large that they are almost violent. This produces a flow of oil 64 into the casing 60 at a relatively high rate through the perforations 62 in the casing. This rate of flow of oil 64 into the casing is significantly higher than that provided by the prior art. The high rate of flow of oil into the casing 60 also causes gravel and sand to be packed tightly around the casing. This inhibits the tendency of sand particles to flow into the casing. Such sand particles tend to damage the oil well pump when they flow into the casing. The high rate of the flow of oil into the casing 60 is also instrumental in eliminating voids in cementing operations in the oil well.

In one embodiment of the invention, concrete 70 is disposed in wet form around the casing 60. While the transducer members such as the transducer members 12 and 24 are vibrating, the transducer assembly 10 is slowly raised. The vibrations in the transducer members produce vibrations in the casing 60. These vibrations cause the air, gas and mud pockets in the concrete 70 to be eliminated so that the concrete is homogeneous. The upward movement of the transducer assembly 10 may be temporarily interrupted at positions where the existence of air, oil and gas pockets is known or suspected.

Alternatively, the concrete 70 may be pumped into the space surrounding the casing 60. As the concrete 70 is pumped into this space, the transducers may be vibrated and raised so as to be disposed at a vertical position slightly below, or at, the vertical position where the concrete is being received. In this way, the elimination of the pockets of air, oil and mud may occur concurrently with the pouring of the concrete.

After the concrete 70 has dried, holes 72 are produced. The holes 72 extend through the casing 60 and the concrete 70 to an area 74 peripherally external to the concrete. The holes 72 may correspond to the holes 62 or they may be different from the holes 62. The holes 72 are provided so that oil in the peripheral area can pass into the casing 60 and be lifted to the surface of the earth.

Although the transducer assembly 10 may be constructed as shown in FIGS. 1 and 2 and described above, other transducers may also be used. For example, a transducer assembly suitable for use in this invention is disclosed and claimed in application Ser. No. 635,669 filed by Eric Plambeck on July 30, 1984, for a "Transducer System" and assigned of record to the assignee of record of this application.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. A method of producing concrete around a casing wall without oil, mud and gas pockets in the concrete, including the steps of:

providing a transducer assembly including at least one transducer having characteristics of resonating at a particular frequency, providing a casing resonant at the particular frequency, disposing the transducer assembly in the casing, disposing wet concrete around the casing, and moving the transducer along the casing, while resonating the transducer at the particular frequency to obtain a resonance of the casing at the particular frequency, to eliminate oil, mud and gas pockets around the casing while the concrete is drying.

2. A method as set forth in claim 1 wherein the transducer in the transducer assembly vibrates in the hoop mode to induce the vibrations in the casing and wherein the transducer assembly is spaced from the casing.

3. A method as set forth in claim 2 wherein the transducer assembly is disposed in a tubing and fluid is disposed in the tubing and the fluid in the tubing transmits such vibrations to the casing.

4. A method as set forth in claim 1 wherein holes are bored through the casing and the concrete, after the concrete has dried, to provide for the flow of oil into the casing from the area peripherally exterior to the concrete.

5. A method as set forth in claim 1 wherein the transducer assembly is moved slowly along the casing, while resonating the transducer, to eliminate oil, mud and gas pockets around the casing while the concrete is drying.

6. A method as set forth in claim 5 wherein the casing and the transducer assembly are resonant at a frequency of approximately four hundred (400) hertz and where the movement of the transducer assembly along the casing is interrupted temporarily at positions where air, gas or mud pockets are known or suspected to exist in the concrete.

7. A method as set forth in claim 1 wherein the casing and the transducer assembly are resonant at a frequency of approximately four hundred (400) hertz.

8. A method of producing concrete around a casing wall without any oil, mud and gas pockets in the concrete, including the steps of:

providing a hollow cylindrical casing with characteristics to resonate in a hoop mode at a particular frequency, disposing cylindrical transducer means within the casing in spaced relationship to the casing with characteristics to resonate in the hoop mode at the particular frequency, the cylindrical transducer means including at least one transducer member constructed to vibrate in the hoop mode at the particular frequency and to institute resonances of the casing in the hoop mode at the particular frequency, disposing wet concrete around the casing, and moving the transducer means along the casing, while resonating the transducer means at the particular frequency to obtain a resonance of the casing at the particular frequency, to eliminate air, gas and mud pockets in the concrete while the concrete is still wet.

9. A method as set forth in claim 8, including the step of:

temporarily interrupting the movement of the transducer means along the casing at positions where air, gas or mud pockets are known or suspected to exist in the concrete.

10. A method as set forth in claim 9 wherein the transducer means and the casing are resonant at a frequency of approximately four hundred (400) hertz.

11. A method as set forth in claim 8 wherein holes are bored through the casing and the concrete, after the concrete has dried, to provide a communication between the interior of the casing and the area around the concrete.

12. A method as set forth in claim 11 wherein the transducer means include a tubing holding the transducer and fluid is disposed in the tubing to fill the tubing and wherein the movement of the transducer means along the casing is temporarily interrupted at positions where oil, gas or mud pockets are known or suspected to exist.

13. A method as set forth in claim 8 wherein the transducer means is moved slowly along the casing, while resonating the transducer means, to eliminate air, gas and mud pockets in the concrete while the concrete is still wet.

* * * * *